US005684852A

United States Patent [19]

Tomie

[11] Patent Number: 5,684,852

[45] Date of Patent: Nov. 4, 1997

[54] X-RAY LENS

[75] Inventor: Toshihisa Tomie, Tsukuba, Japan

[73] Assignee: Agency of Industrial Science & Technology, Ministry of International Trade & Industry, Tokyo, Japan

[21] Appl. No.: 736,680

[22] Filed: Oct. 25, 1996

Related U.S. Application Data

[62] Division of Ser. No. 389,503, Feb. 16, 1995, Pat. No. 5,594,773.

[30] Foreign Application Priority Data

Feb. 18, 1994 [JP] Japan ..... 6-45288

[51] Int. Cl.[6] ..... G21K 1/06

[52] U.S. Cl. ..... 378/145; 378/84; 250/505.1; 359/665; 359/811

[58] Field of Search ..... 359/665, 619, 359/709, 710, 711, 712, 713–717, 811; 378/145, 84, 140; 250/505.1

[56] References Cited

U.S. PATENT DOCUMENTS 3,724,924 4/1973 Lenfant et al. ..... 359/710

*Primary Examiner*—Don Wong

*Attorney, Agent, or Firm*—Oblon, Spivak, McClelland, Maier & Neustadt, P.C.

[57] ABSTRACT

An X-ray lens includes a plurality of hollow cylinders of prescribed radius bored in a lens material piece having a phase lag coefficient appropriate for the wavelength of the X-rays to be focused such that the axes of the hollow cylinders are parallel and perpendicularly intersect a straight array axis.

38 Claims, 8 Drawing Sheets

X-RAY LENS

This is a Division of application Ser. No. 08/389,503 filed on Feb. 16, 1995, now U.S. Pat. No. 5,594,773.

BACKGROUND OF THE INVENTION

1. Field of the Invention

This invention relates to a refractive lens for focusing short wavelength X-rays.

2. Description of the Prior Art

It is well known that the complex refractive index n of a material can be expressed by $$n=1-\delta-i\beta \quad (1)$$

and that the following holds $$2\pi(\delta+i\beta)=N_a\cdot r_e\cdot\lambda^2\cdot(f1+if2) \quad (2)$$

where i: $\sqrt{-1}$; δ: phase lag coefficient; β: extinction coefficient; $N_a$: atomic density; $r_e$: classical electron radius; λ: wavelength of light; and f1, f2: atomic scattering factors.

Reflecting mirrors and refractive lenses can easily be fabricated for use in the visible light region since materials having a refractive index n far from unity and a small absorption ($|\beta/\delta|<1$) in this region are readily available. In contrast, optical elements utilizing reflection or refraction are intrinsically difficult to fabricate for use in the X-ray region, since in this region all materials have a refractive index n near unity, i.e. $|\delta|<1$, and exhibit a large absorption.

Consider, for example, a concave piece of material having the shape of a paraboloid of revolution and satisfying the relationship $$r^2=2\delta f(d(r)-d0) \quad (3)$$

where d(r) is the thickness at a distance r measured perpendicularly from the axis and d0 is the thickness at the thinnest portion, namely the portion through which the axis passes. In the case of a small coefficient δ, such a concave piece of material functions as a lens which focuses a plane electromagnetic wave entering parallel to the axis at a focal distance of f. In the particular case where (d(r) −d0) is considerably smaller than r, Equation (3) can be approximated to a spherical surface of radius R, as shown by Equation (4)

$$R=\delta f \quad (4).$$

Since in the X-ray region δ generally has an extremely small absolute value on the order of $10^{-5}$, however, a lens fabricated according to Equation (4) would have a very long focal distance in the X-ray region. For instance, a concave lens fabricated of beryllium to have a radius of curvature R=1 cm would have a focal distance f of 4.5 Km with respect to X-rays of wavelength λ=0.1 nm (such X-rays will hereinafter be referred to as 0.1 nm X-rays). Since the atomic scattering factor f1 of a material is approximately proportional to its atomic number Z, shorter focal distances can be obtained by using materials with larger atomic numbers Z. Still, even if gold (Z=79) is used, the focal distance is reduced to only around 220 m, or about 1/20th that of a beryllium lens.

Much work has gone into the development of techniques enabling the fabrication of X-ray optics. Among relatively early studies on refractive lenses is that published by P. Kirkpatrick (J.Opt.Soc.Am.39(1949)746). Kirkpatrick predicted that a linear focal pattern would be obtained when an 0.07 nm X-ray enters the concave side of an optical concave lens obliquely at an extremely shallow angle on the order of several μrad. Since oblique incidence at an extremely shallow angle results in large aberration, however, the focusing characteristics obtained by this method are very poor and the absorption by the substrate is quite heavy. This is no doubt why no other studies on refractive X-ray lenses have been reported.

Focusing of X-rays has been attempted not by use of transmission lenses but by reflection techniques. When an electromagnetic wave is reflected at an interface where the refractive index is discontinuous, the reflection intensity increases with increasing difference in refractive index at the interface. In the X-ray region, however, where all materials exhibit a refractive index n near unity, the normal incident reflectance at a single interface is extremely small. This led to the idea of using a very shallow X-ray incidence angle for meeting the total reflection condition. When a beam of 1 nm X-rays fall incident on gold or some other metal at a shallow angle of 20 mrad, for example, the reflectance is on the order of several tens of percent. However, the large aberration that arises in the case of oblique incidence to a spherical surface again makes it impossible to obtain good focusing characteristics.

The Wolter-type optical system employing an ellipsoid of revolution and the Kirkpatrick-Baez-type optical system employing two perpendicularly intersecting elliptic cylinders were developed for mitigating this aberration problem. These oblique incidence optical systems can focus X-rays down to short wavelengths of around 0.08 nm. Aspheric surfaces are, however, difficult to fabricate with high precision.

Research has therefore been conducted for enabling spherical reflecting mirrors, which are relatively easy to fabricate with precision, to be used with normal incidence, which is advantageous from the point of aberration characteristics. Specifically, attempts have been made to take advantage of the fact that when a large number of interfaces are laminated at a fixed period, the intensifying effect produced by interference between the very weak X-ray waves reflected from the individual interfaces makes it possible to obtain a large reflectance notwithstanding the extremely small normal reflectances at the individual interfaces. This led to the development of multilayer X-ray reflecting mirrors consisting of a large number of laminated films each of a thickness approximately equal to one-quarter of the wavelength of the X-rays to be focused. Research into reflecting mirrors of this type has become particularly active since the development by T. Barbee et al. (Appl. Opt.24 (1985)883) of a multilayer X-ray reflecting mirror with an unprecedented high reflectance of 65% with respect to 17 nm X-rays. Since this breakthrough, multilayer spherical reflecting mirror systems featuring imaging resolutions of several tens of nm have been developed. Among the advantages of these optical systems are that they can be built with diameters up to several tens of mm and that they permit relatively large converging angles of around 0.2 rad.

Separately from the foregoing, A. V. Baez (J. Opt. Soc. Am.42(1952)756) proposed a diffraction method for focusing X-rays by use of a Fresnel zone plate. The Fresnel zone plate has a large number of concentric ring-like openings spaced at prescribed intervals and decreasing in width toward the outside and can be used to focus X-rays by utilizing the interference between the diffracted X-rays from the individual rings. The size of the focal point is restricted by the width of the outermost ring and diffraction efficiency is less than 10%. Condenser zone plates of a diameter of 1 mm, an outermost ring width of 0.3 μm and a focal distance of about 10 cm and microzone plates of a diameter of 20-plus μm, an outermost ring width of 50 nm and a focal distance of about 0.6 mm are currently being produced. However, the converging angles of these plates is only several tens of mrad.

Still, no X-ray system capable of satisfactorily focusing X-rays of short wavelengths under 1 nm to a diameter of several μm has yet been developed. Minute pinholes continue to be used. It is possible to produce a 0.04 nm X-ray microbeam or the like using a pinhole.

Although various X-ray focusing techniques have been developed as described in the foregoing, none is entirely satisfactory. Although some of these techniques have notable merits, they also have numerous drawbacks. Those that employ oblique incidence cannot be practically applied because of their large aberration. On the other hand, optical systems designed to mitigate this drawback by use of optical elements that are aspherical or have noncircular cross-sections, such as those of the Wolter-type and Kirkpatrick-Baez-type, are difficult to fabricate, especially when high precision is required.

It is also difficult to fabricate and achieve high precision in multilayer reflecting mirrors in the short wavelength region, even though they can use spherical optical elements and allow normal incidence, because of such stringent conditions as that the thickness of each layer has to be equal to one-quarter the wavelength of the X-rays to be focused as well as precisely constant and that the interfaces have to be clearly defined. It is in fact difficult to form multiple film layers at a short period so as to produce clearly defined interfaces with low surface roughness. As a result, an appreciable degree of reflectance can be achieved by normal incidence only at wavelengths of 4.4 nm or greater. Although X-rays with fairly short wavelengths can be focused by using oblique incidence, the method using oblique incidence is, as explained earlier, fundamentally undesirable. In other words, presently available multilayer X-ray reflecting mirrors provide high resolution when used for focusing X-rays of relatively long wavelengths of several tens of nm and longer, but are not suitable for focusing short wavelength X-rays.

Although the Fresnel zone plate described above can focus X-rays of shorter wavelength than can be focused with a multilayer optical system, it nevertheless does not perform well when the X-ray wavelength is too short, owing to the increase in X-ray penetration power with decreasing wavelength, and is therefore limited to applications at wavelengths down to, at best, 2–3 nm. Moreover, as was pointed out earlier, it has a low diffraction efficiency of around 10% and is not easy to fabricate.

In the method using a pinhole instead of an optical system, moreover, for X-rays in the high penetration power wavelength range the pinhole has to be formed in a substrate of considerable thickness. Since it is difficult to bore a pinhole with a large aspect ratio (ratio of thickness to diameter) with high precision, as well as for other reasons, it is not actually possible to form a pinhole with a submicrometer diameter. An even more fatal defect of this method is that almost all of the incident X-ray energy is cut off and goes to waste, so that the transmitted X-ray intensity is extremely low.

This invention was accomplished in light of the foregoing shortcomings of the prior art and aims at providing an X-ray refractive lens which enjoys an extended applicable wavelength range, provides good focusing performance, and is relatively easy to fabricate.

This invention was accomplished after the following considerations by the inventor:

(1) While a material having a concave shape of a paraboloid of revolution as indicated by the aforementioned Equation (3) is theoretically ideal as an X-ray lens, a piece of material with a spherical concave surface of radius R can approximate an X-ray lens having the focal distance f given by the aforementioned Equation (4) within a practical range.

(2) The extent to which the focal distance f can be shortened merely by reducing the radius R has limits in terms of fabrication technology and practical use, and hence the focal distance f remains quite long even after maximum practical reduction.

(3) The total focal distance $f_T$ can be reduced to f/N by cascading N X-ray lenses of long focal distance f, as shown in FIG. 1. In this configuration, however, many unit X-ray lenses have to be arranged after fabricating the individual unit X-ray lenses. The thickness of each unit X-ray lens has to be very thin to avoid strong absorption of X-rays, making each unit X-ray lens very fragile and difficult to handle. Moreover, aligning the optical axes of all unit X-ray lenses along the X-ray lens axis with high precision would be extremely difficult. Hence, arranging many X-ray lenses in the configuration shown in FIG. 1 is practically impossible.

For coping with the above problems, the inventor conceived the idea of disposing hollow hemispheres in a flat plate as shown in FIG. 2(*a*), in which X-rays enter from the side surface of the plate. The inventor further conceived the idea of disposing hollow cylinders instead of hemispheres for easier fabrication.

In the configurations shown in FIG. 2, all unit X-ray lenses can be fabricated in a single substrate, enabling the alignment of all X-ray lenses along the X-ray axis with high precision. Absorption of X-rays can be minimized by disposing the unit X-ray lenses very closely. Moreover, since hollow cylinders are very easy to bore, an X-ray lens composed of many hollow cylinders as shown in FIG. 2(*b*) can be fabricated very easily.

In the present invention, a unit X-ray lens made of a hollow cylinder or hollow hemisphere of radius R has a focal distance $f_U$ represented by $$f_U = R/2\delta \quad (5).$$

The reason for the focal distance $f_U$ represented by Equation (5) being half that of the focal distance f represented by Equation (4) is that the unit lens contains two concave surfaces along the X-ray axis indicated by the dashed lines in FIG. 2.

When N unit lenses are aligned, the effective focal distance $f_T$ with respect to a beam of X-rays entering the axis of the unit lens array, i.e., the X-ray lens axis, is $$f_T = f_U/N \quad (6).$$

For obtaining good focusing characteristics with a lens of this configuration, the machining has to be conducted at a high precision capable of keeping the geometric error within a small fraction of the value obtained by dividing the wavelength of the X-rays to be focused by δ of the lens material (=λ/ δ). Even so, the machining precision required is far less stringent than that required for the fabrication of a prior art oblique incidence optical system, multilayer reflecting optical system, zone plate or the like. In addition, existing technologies are available for high-precision linear alignment of the N number of hollow cylinders or hollow hemispheres.

SUMMARY OF THE INVENTION

This invention provides an X-ray lens comprising N number (N≧2) of unit lenses each constituted by forming a hollow cylinder in a piece of lens material capable of transmitting X-rays to be focused, the hollow cylinders being aligned on a straight array axis with their axes parallel to each other.

The N number of hollow cylinders can easily be designed and fabricated so that their individual radii Rj ($1 \leqq j \leqq N$) are equal, i.e. such that Rj ($1 \leqq j \leqq N$)=R. While this is the ordinary configuration, it is not, however, a requisite. Some of the N number of hollow cylinders can have radii Rj ($1 \leqq j \leqq N$) which are different from those of the others or all of the radii can be different. In such cases, the following relationship holds between the aforesaid numerical value R and the radii R1, R2 . . . RN of the first to Nth hollow cylinders $$(1/R)=\{(1/R1)+(1/R2)+\ldots+(1/RN)\}/N \quad (7).$$

In other words, when some or all of the hollow cylinder radii differ, the X-ray lens can be treated as one consisting of an array of N number of hollow cylinders of radius R calculated according to Equation (7). The numerical value of R calculated in this manner can thus be used during lens design as a parameter for precalculation of the final focal distance or for determining the shape of correction elements to be described later. Equation (7) is solved for the value of R contained therein in reciprocal form. Expressed verbally, this amounts to treating R as the value obtained by dividing the numerical value N by the sum of the reciprocals of the radii Rj ($1 \leqq j \leqq N$) of the individual hollow cylinders, i.e., by $\{(1/R1)+(1/R2)+\ldots+(1/RN)\}$. If all of the radii Rj ($1 \leqq j \leqq N$) are equal, the right side of Equation (7) becomes the same as the left side (1/R).

In the actual fabrication of the X-ray lens according to this aspect of the invention, the aforesaid basic configuration can best be achieved in the form of an X-ray lens obtained by drilling a single piece of lens substrate to have N number of parallel hollow cylinders aligned on an array axis and individually constituting unit lenses. In other words, a single piece of substrate is used as the lens material for the individual unit lenses.

In accordance with a second aspect of the invention, hollow hemispheres are used in place of the aforesaid hollow cylinders. (The statements made above regarding the radius Rj ($1 \leqq j \leqq N$) also apply in this case.) Moreover, instead of perfect hollow hemispheres it is possible to use depressions constituted as a part of a spherical space. The invention also provides an X-ray lens constituted of so-configured unit lenses.

A third aspect of the invention provides an X-ray lens consisting of first and second sublenses each constituted in the manner of the aforesaid X-ray lens consisting of hollow cylinder unit lenses, wherein the first and second sublenses are disposed in tandem on a common array axis and the hollow cylinder group constituting the N number of unit lenses of the first sublens and the hollow cylinder group constituting the N number of unit lenses of the second sublens are disposed with the axes of their hollow cylinders at right angles to each other. For adjusting the focal distance of the X-ray lens according to this aspect of the invention, the number of unit lenses in one or the other of the first and second sublenses can be made a number M which is different from the number N. Moreover, the first and second sublenses need not be formed in separate pieces of lens material but can be formed in a single piece of lens material. In addition, one or the other of the first and second sublenses can be divided in two (so that the total number of sublenses becomes three), with one of the divisions having (N−X) number of unit lenses and the other division having X number of unit lenses, and the remaining (undivided) sublens be inserted therebetween. X is a number equal to or greater than 1 and less than N. Generally, X=N/2.

A fourth aspect of the invention provides an X-ray lens consisting of first and second sublenses each constituted in the manner of the aforesaid X-ray lens consisting of hollow hemispheres unit lenses, wherein one of the first and second sublenses is inverted and placed on top of the other with the axes of the hollow hemispheres perpendicular to the array axis. In this case, since each unit lens of the first and second sublenses can be registered with a unit lens of the other sublens at a point on the array axis, there can be obtained a compact configuration consisting of N number of spherical spaces each formed by a pair of registered unit lenses and aligned in the array axis direction. This is not limitative, however, and the function of the X-ray lens is manifested even when the first and second sublenses are offset in the direction of the array axis, insofar as they are aligned on the array axis.

This invention further provides X-ray lenses equipped with a spherical aberration correction element for correcting the spherical aberration produced by the substantially linear arrangement (cascade arrangement) of the N number of unit lenses, an intensity correction element for obtaining uniform intensity distribution of the X-rays transmitting through the N number of unit lenses, and a gap configuration for reducing attenuation of the transmitted X-ray intensity by the material between unit lenses adjacent in the direction of the array axis.

The above and other objects, characteristic features and advantages of this invention will become apparent to those skilled in the art from the description of the invention given hereinbelow with reference to the accompanying drawings.

BRIEF EXPLANATION OF THE DRAWINGS

FIG. 2(*b*) is a schematic perspective view showing a cascaded X-ray refractive lens having hollow cylindrical surfaces disposed in a lens substrate for easy fabrication.

DESCRIPTION OF THE PREFERRED EMBODIMENTS

Figure 1:
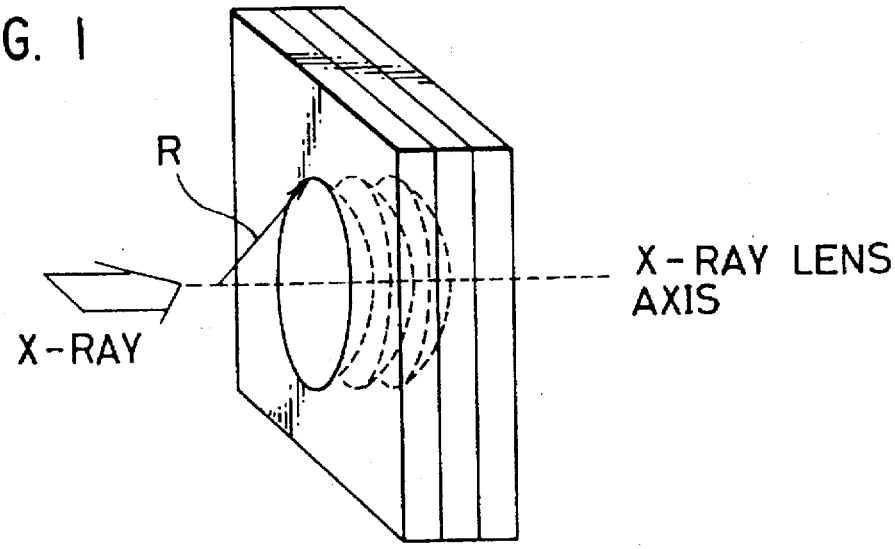
FIG. 1 is a schematic perspective view showing a cascade of X-ray refractive lenses which is capable of shortening the total focal distance but whose lenses are difficult to handle and whose optical axes are practically impossible to align along the X-ray lens axis.
Figure 2A:
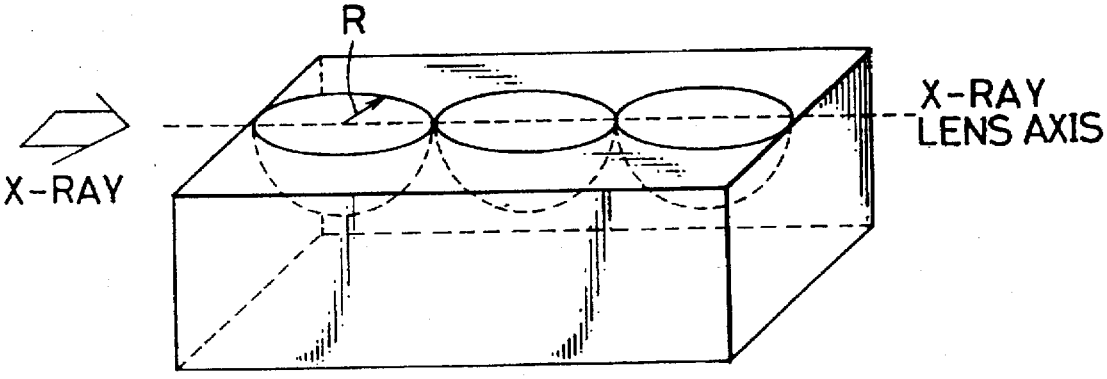
FIG. 2(*a*) is a schematic perspective view showing a cascaded X-ray refractive lens having hollow hemispherical surfaces disposed in a lens substrate for easy alignment of the optical axes along the X-ray lens axis.
Figure 2B:
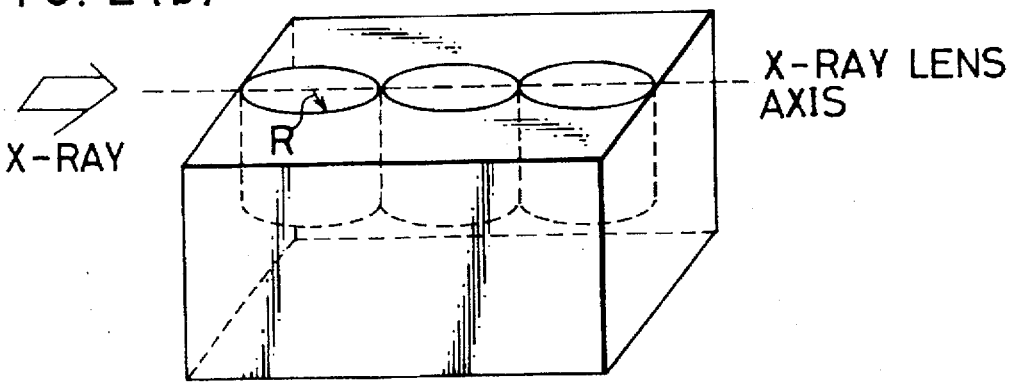
Figure 3:
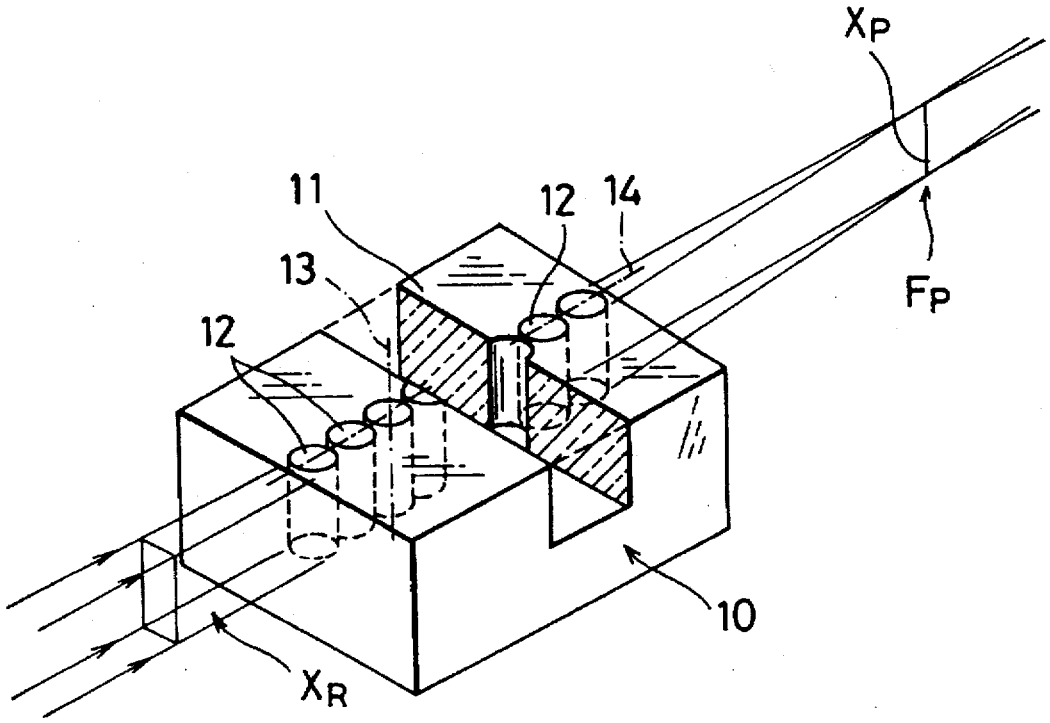
FIG. 3 is a schematic perspective view of an X-ray lens which is a first embodiment the invention.

FIG. 3 shows an X-ray lens 10 which is a first embodiment of the invention for focusing an X-ray beam $X_R$ of wavelength λ. The X-ray lens 10 according to this embodiment is constituted by boring N number (N≧2) of hollow cylinders 12 in the thickness direction of a solid lens material piece 11 having the shape of a rectangular parallelopiped or flat plate. The radii Rj (1≦j≦N) of the hollow cylinders 12 in this embodiment are all equal to the same value R. Defining the phase lag coefficient of the lens material piece 11 at the wavelength λ of the X-ray beam $X_R$ to be focused as δ, it follows from Equation (5) that each hollow cylinder 12 functions as a unit X-ray lens 12 having a focal distance $f_U$. In other words, when the hollow cylinder type unit X-ray lenses 12 are formed to a very small diameter for use as X-ray lenses, each very closely approximates the ideal paraboloid of revolution defined by Equation (3) and, as such, provides a practical lens effect.

As was pointed out earlier, however, the focal distance of a single hollow cylinder 12 is much too long for use in focusing X-rays. In this invention, therefore, N number of hollow cylinders 12 are cascaded with their axes 13 aligned parallel to each other and perpendicular to an X-ray lens axis 14. The overall X-ray lens 10 consisting of the N number of hollow cylinders 12 (unit lenses 12) thus has its effective focal distance $f_T$ reduced to $f_U/N$. An X-ray beam $X_R$ entering the X-ray lens along the array axis of the unit lenses 12 is focused as a line of focused X-rays $X_P$ at a focal line $F_P$ corresponding to an effective focal distance $f_T$ whose magnitude falls within a practically utilizable range.

The focal distance $f_T$ of the so-configured X-ray lens 10 can be shortened as desired by increasing the number N of aligned unit lenses 12. For obtaining a practical lens aperture at a practical focal distance, however, it is preferable for δ of the lens material piece 11 through which the X-rays are transmitted to be large as possible. Since δ of a material is approximately proportional to its density, it is advisable to use a material with a large specific density. On the other hand, if X-ray absorption has to be minimized, it is necessary to use a lens material piece 11 having a low X-ray absorption coefficient (attenuation coefficient) β. Since the problem of absorption grows more severe as the wavelength λ of the X-rays to be focused increases, δ has to be increased when the lens is used to focus relatively long wavelength X-rays.

Thus suitable lens materials for different wavelength X-rays include, for example, lithium (atomic number Z=3) for focusing 1–0.3 nm X-rays, beryllium (Z=4) for focusing X-rays with wavelengths in the vicinity of 0.2 nm, and chromium (Z=24) for focusing X-rays with wavelengths in the vicinity of 0.06 nm. This is not limitative, however, and other materials can be used if priority has to be given to machining ease or some other factor. In some cases, such as in the use of aluminum for 0.8 nm X-rays and silicon for 0.7 nm X-rays, the most suitable material from the viewpoint of wavelength is also an excellent material from the viewpoint of machinability. What has been said here also applies to the other embodiments of the invention described later.

Two specific examples of X-ray lenses according to the first embodiment will now be described. The first can be fabricated by boring 10 hollow cylinders 12 of radius R=400 μm along a straight line 14 extending in the longitudinal direction of an 8 mm-long beryllium plate 11 (the lens material piece 11). A straight line passing through the axes of all of the ten hollow cylinders 12 at right angles thereto is defined as the X-ray lens axis and the distance between adjacent hollow cylinders 12 in the direction of the array axis is reduced as much as possible. As a result, the focal distance $f_T$, which is inversely proportional to the reciprocal of the square of the wavelength λk of the X-ray beam $X_R$, is approximately 50 cm for 0.8 nm X-rays in the case of this specific example of the X-ray lens 10 and an X-ray beam measuring 300 μm in width ($R_x$=150 μm) can be focused. (Although FIG. 3 shows a rectangular X-ray beam $X_R$ incidence pattern covering the whole of the usable area, it will be understood that any arbitrary incidence pattern falling within this region can be used.) Moreover, the converging angle θ given by $\theta=2R_X/f_T$ is 0.6 mrad and the convergence diameter $\Delta X=\lambda/\theta$ is 1.3 μm.

The second specific example can be fabricated by boring 50 hollow cylinders 12 of radius R=500 μm along a straight line 14 extending in the longitudinal direction of a 50 mm-long carbon plate 11 (the lens material piece 11). This provides an X-ray lens 10 having a focal distance $f_T$ of 165 cm for 0.1 nm X-rays. The converging angle θ is 0.14 mrad and the convergence diameter ΔX was 0.7 μm. The effective lens diameter is estimated to be 230 μm, which is smaller than the diameter 2R of the hollow cylinders.

As will be understood from the foregoing, the invention provides a highly practical X-ray lens which can be easily fabricated. Even hollow cylinders 12 of a diameter one order of ten smaller than those of the aforesaid specific examples can be bored with sufficiently high precision by using a microdrill. Moreover, various other machining technologies are also currently available for this purpose, including, for example, laser beam machining and lithographic technologies used in the fabrication of semiconductor integrated circuits and the like. The fact that the invention uses unit lenses with circular instead of noncircular cross-sections proves to be a major advantage during actual lens fabrication.

The X-ray lens 10 shown in FIG. 3 is constituted by boring N number (N≧2) of hollow cylinders 12 in a single lens material piece 11. This is not limitative, however, and the principle of the invention enables it to be embodied also in various other ways. For example, a plurality of lens material pieces 11 each having a single hollow cylinder 12 can be used as the unit lenses and these unit lenses can be disposed physically adjacent or near to each other to fabricate an invention X-ray lens 10 which is constituted substantially of the same group of hollow cylinders as shown in FIG. 3. This also applies to the embodiments described later.

Figure 4A:
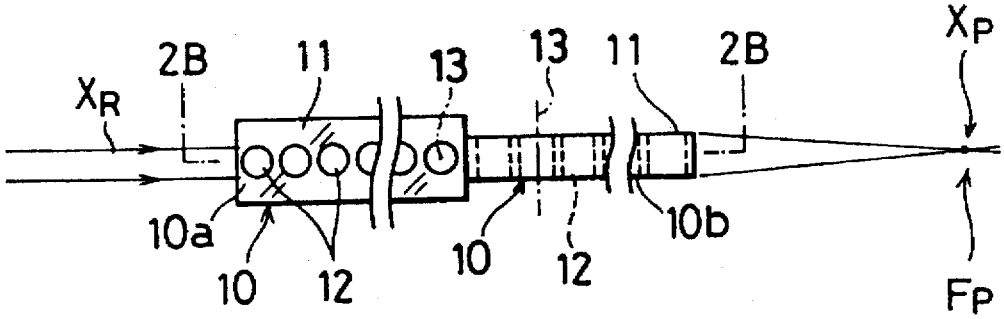
FIGS. 4(*a*) to 4(*c*) are schematic views showing first embodiment of FIG. 3 as modified for point focusing.
Figure 4B:
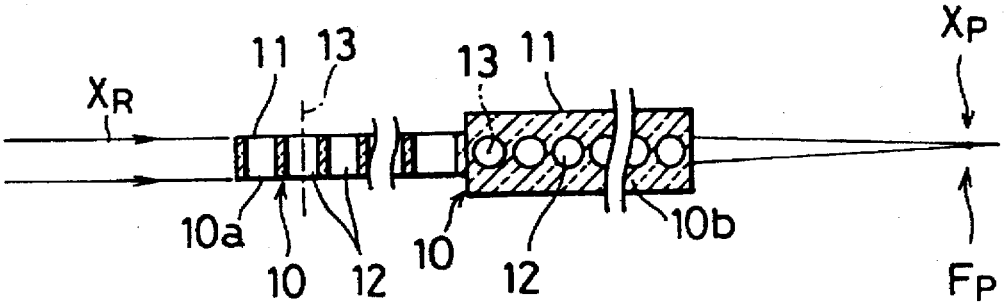
Figure 4C:
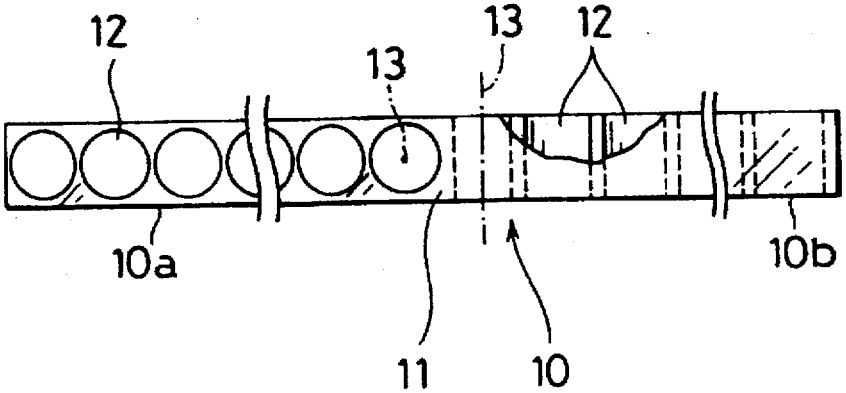

Although the X-ray lens 10 constituted in the foregoing manner produces a focused X-ray line $X_P$ at the focal line $F_P$, the technique shown in FIG. 4 can be used for obtaining a focused X-ray point $X_P$. As shown in FIG. 4(*a*) and FIG. 4(*b*) (which is a sectional view taken along line 2B—2B of FIG. 4(*a*)), this embodiment has first and second sublenses 10*a*, 10*b*, each configured in the manner of the X-ray lens 10 described above. The first and second sublenses 10*a*, 10*b* are placed in tandem with their hollow cylinders 12 aligned on a common array axis but with the axes of their hollow cylinders 12 lying perpendicular to each other. With this configuration, the focal line $F_P$ of the first embodiment becomes a focal point $F_P$ and the focused X-ray line $X_P$ becomes a focused X-ray point $X_P$.

As is obvious from FIGS. 4(*a*) and 4(*b*), however, the distance between the point at which the X-rays enter the first sublens 10*a* and the focal point $F_P$ differs from the distance between the point at which the X-rays enter the second sublens 10*b* and the focal line $F_P$. In some cases, therefore, it may be desirable to adjust the focal distances of the first and second sublenses 10*a*, 10*b* to different values. This can be achieved by boring a different number (M number) of hollow cylinders in the second sublens 10*b* than the number (N number) bored in the first sublens 10*a* or by making the radius R of the hollow cylinders 12 bored in the second sublens 10*b* different from that of the hollow cylinders 12 bored in the first sublens 10*a*. It is also possible, within limits, to leave a space between the first and second sublenses 10*a*, 10*b* and to adjust the difference in the focal distances of the two sublenses by varying the size of the space. This "space" (and the "gap" referred to later) is a void not occupied by the lens material. It can be totally evacuated (vacuum state), be occupied by air or some other gas, or contain a material having an absorption coefficient that does not cause a problem at the wavelength of the X-rays to be focused. In other words, a "space" or "gap" as termed herein can be any region that behaves as such at the X-ray wavelength concerned.

While the first and second sublenses 10*a*, 10*b* are shown as separate components in FIGS. 4(*a*) and 4(*b*), they can instead be formed in a single lens material piece 11 as shown FIG. 4(*c*), in which case the X-ray lens 10 can be formed as a unitary optical element. In the illustrated case, a single lens material piece 11 of rectangular section is formed on its left half with all of the members of a first group of hollow cylinders 12 constituting the first sublens 10*a* and on its right half with all of the members of a second group of hollow cylinders 12 constituting the second sublens 10*b*, such that the axes 13 of the first and second groups of hollow cylinders 12 lie perpendicular to each other. Other arrangements are also possible. For example, an X-ray lens functionally equivalent to the X-ray lens 10 of FIGS. 4(*a*), 4(*b*) can also be obtained by alternately boring the hollow cylinders so that the axes of adjacent hollow cylinders or adjacent subgroups of hollow cylinders lie perpendicular to each other as viewed parallel to the array axis. This same principle can also be applied, for example, by dividing one of the first and second sublenses 10*a*, 10*b* (10*a* for example) in two, with one of the divisions having (N−X) number of unit lenses and the other division having X number of unit lenses, and inserting the second sublens 10*b* therebetween. X is a number equal to or greater than 1 and less than N. Generally, it is preferable for the divided sublens to be split in half, i.e., for X to equal N/2. This arrangement can also be achieved by forming the sublenses in a single lens material piece. Moreover, it is also possible to combine four or more X-ray lenses according to this invention.

Further, the radii Rj ($1 \leqq j \leqq N$) of the N number of hollow cylinders do not all have to be equal to the same value R. Instead, some of the hollow cylinders can have radii Rj ($1 \leqq j \leqq N$) which are different from those of the others or all of the radii can be different. This is true irrespective of whether the X-ray lens 10 is constituted as a single unit or as a combination of sublenses. The lens obtained in this way is equivalent to that obtained by aligning N number of hollow cylinders of the equivalent radius R calculated according to Equation (7) and has the focal distance $f_T$ of such a lens. What this means is that the effective focal distance $f_T$ of the X-ray lens 10 according to this invention can be intentionally adjusted by differing the radius Rj of the individual hollow cylinders. A similar statement can also be made regarding the embodiment employing hollow hemispheres to be described next.

Figure 5:
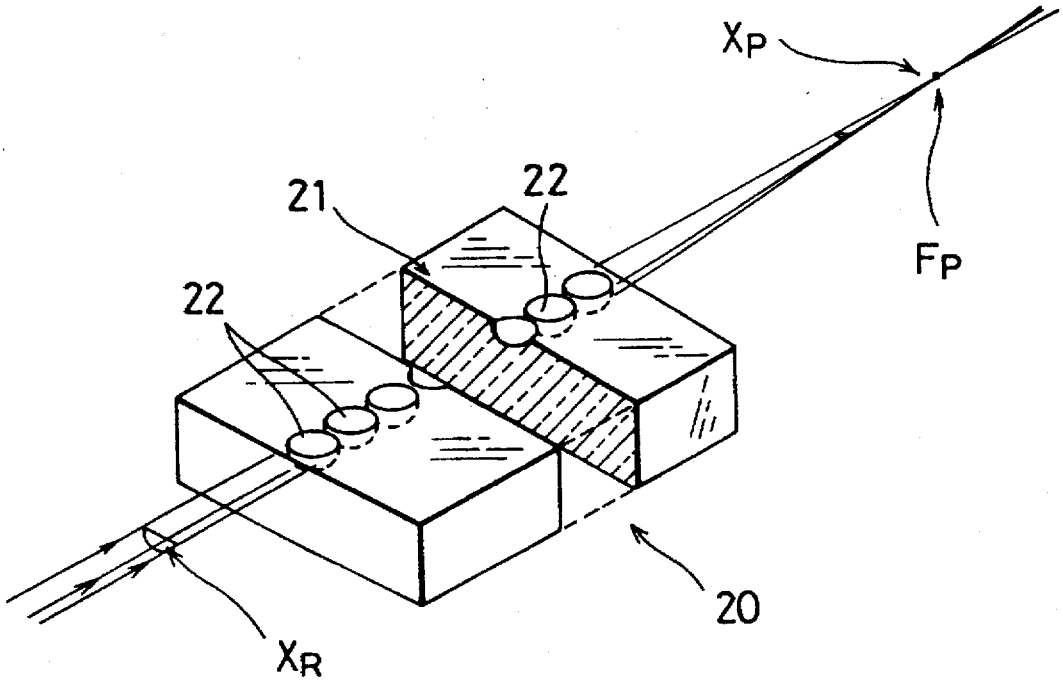
FIG. 5 is a schematic perspective view of an X-ray lens which is a second embodiment of the invention, the hollow cylinder unit lenses of the first embodiment are replace, with hollow hemisphere unit lenses.

FIG. 5 shows another embodiment of the invention. Reference numerals 20, 21, 22 in this figure indicate members corresponding to those indicated by the reference numerals 10, 11, 12 in the earlier embodiments. This embodiment differs from the earlier ones in that it uses hollow hemispheres 22 to form the unit lenses. More specifically, the X-ray lens 20 according to this embodiment is constituted by forming N number ($N \geqq 2$) of hollow hemispheres 22 of radius R in a solid lens material piece 21 having the shape of a rectangular parallelopiped or flat plate such that their axes intersect an array axis (a straight line). In accordance with Equation (5) which closely approximates Equation (3), each hollow hemisphere 22 functions as a unit lens 22 with a focal distance $f_U$. If the number N of aligned hollow hemispheres 22 is made sufficiently large, the effective focal distance $f_T$ of the X-ray lens 20 can be made practically short owing to the relationship $f_T = f_U/N$ . As a result, an X-ray beam $X_R$ of semicircular section entering the X-ray lens 20 along the array axis is focused at a focal point $F_P$ as a focused X-ray semicircle $X_P$ whose microscopic semicircular shape can be considered a point for most purposes.

Figure 6:
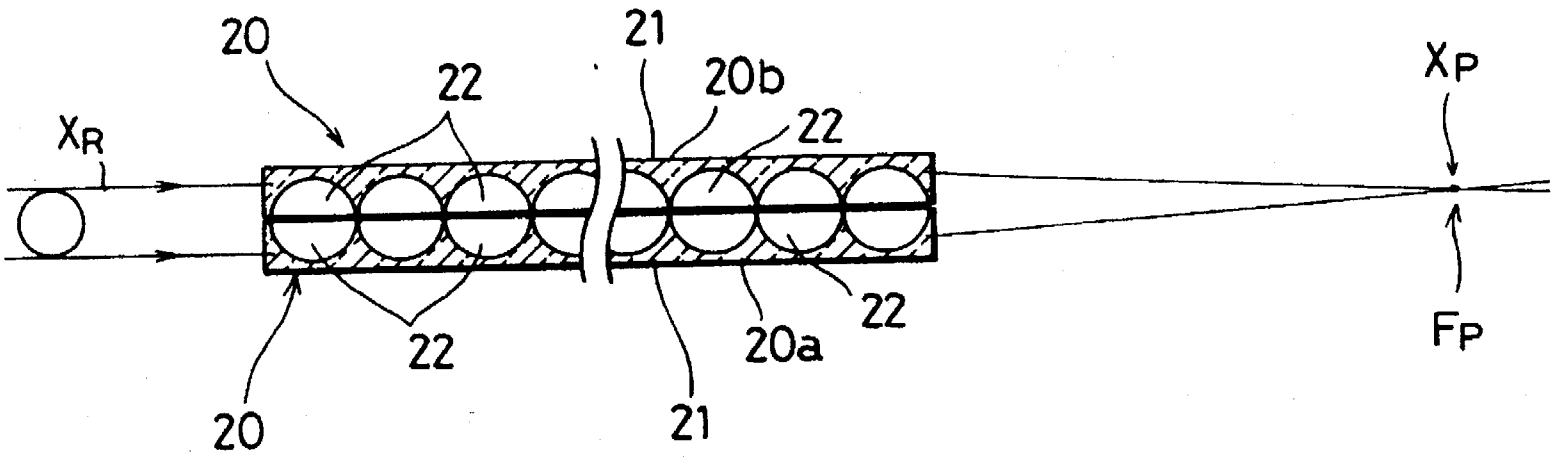
FIG. 6 is a schematic view showing the second embodiment of FIG. 5 as modified for point focusing.
Figure 7A:
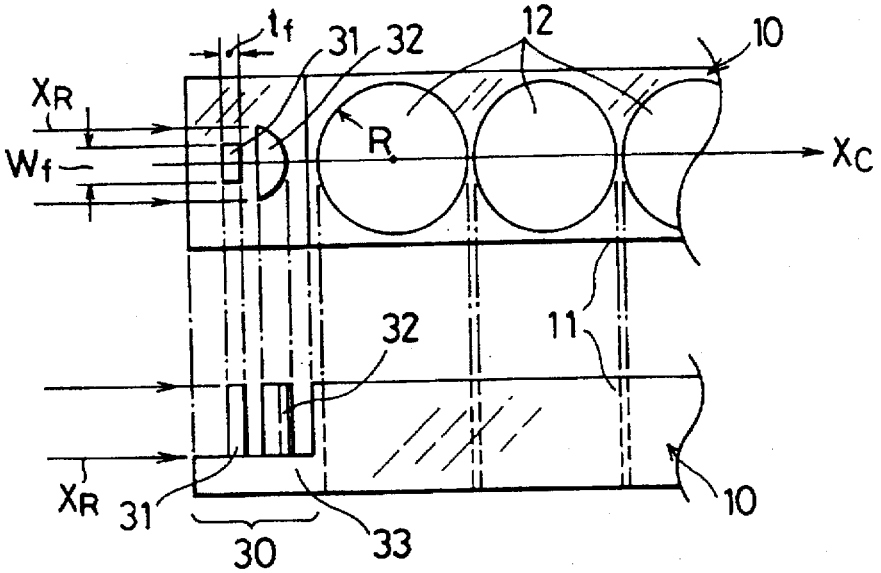
FIGS. 7(*a*) to 7(*e*) are explanatory views of correction elements for correcting spherical aberration and uneven X-ray transmission intensity in the X-ray lens shown in FIG. 3.
Figure 7B:
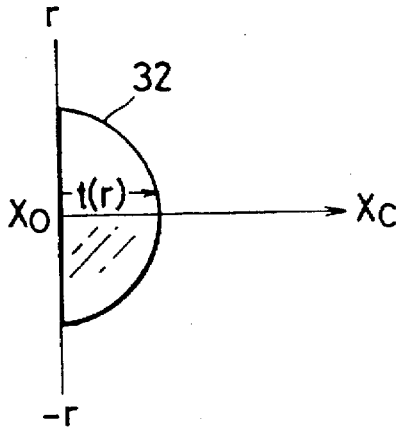
Figure 7C:
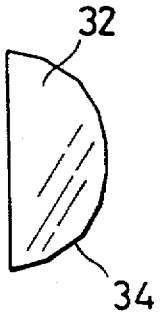
Figure 7D:
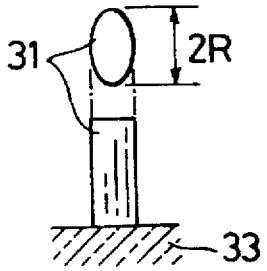
Figure 7E:
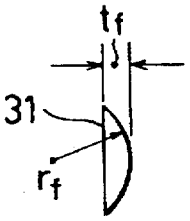
Figure 8A:
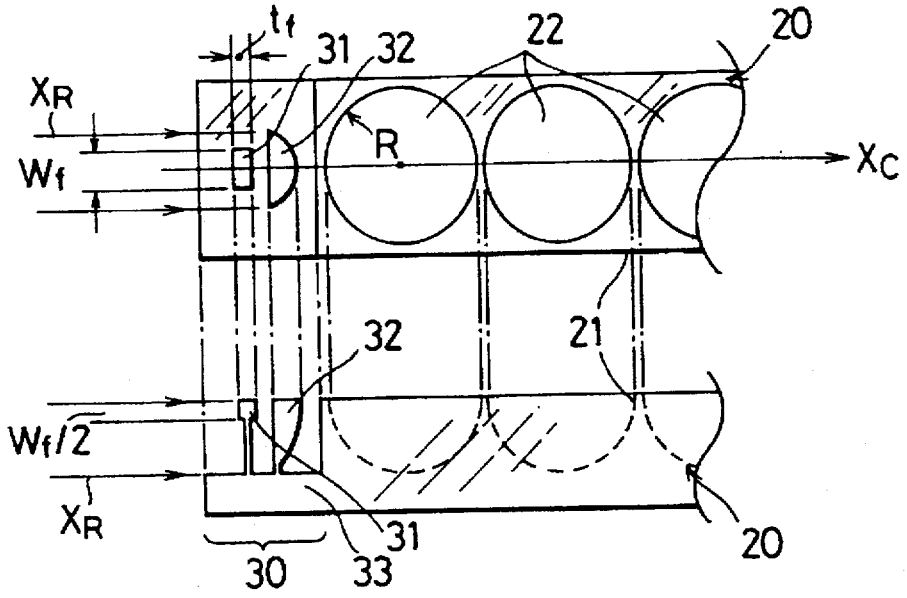
FIGS. 8(*a*) to 8(*e*) are explanatory views of correction elements for correcting spherical aberration and uneven X-ray transmission intentsity in the X-ray lens shown in FIG. 5.
Figure 8B:
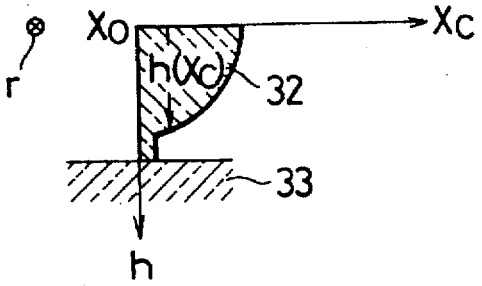
Figure 8C:
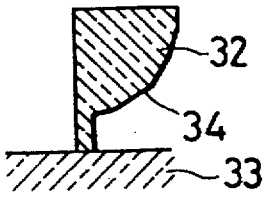
Figure 8D:
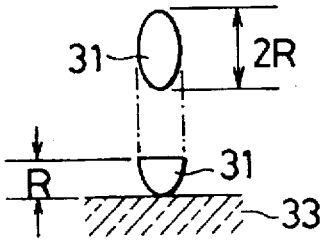
Figure 8E:
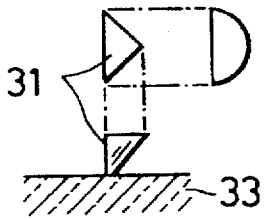

A circular X-ray beam can be focused by adopting the configuration of FIG. 6, which comprises first and second sublenses 20*a*, 20*b* each constituted in the manner of the aforesaid X-ray lens consisting of hollow hemisphere unit lenses, with one of the first and second sublenses 20*a* or 20*b* being inverted and placed on top of the other such that the axes of its hollow hemispheres intersect the array axis. A circular X-ray beam $X_R$ entering the X-ray lens 20 of this configuration is converged to a focused X-ray point $X_P$ at the focal point $F_P$.

In the configuration according to FIG. 6, the N number of hollow hemispheres 22, 22 are formed at positions along the respective array axes of the first and second sublenses 20*a*, 20*b* so as to register in pairs each forming a hollow spherical space when one of the sublenses is inverted and placed on top of the other. While this is preferable from the point of reducing the size of the X-ray lens according to this invention, it is not a requirement. The X-ray lens can fulfill its function even when the first and second sublenses 20*a*, 20*b* are offset in the direction of the array axis.

The hollow hemispheres 22 can be formed with sufficient precision by any of various existing technologies such as electric discharge machining, isotropic etching, or use of a mold having spheres formed along a straight line. Even so, the machining precision required for forming the hollow hemispheres 22 or the aforesaid hollow cylinders 12 is far less stringent than that required for the fabrication of a prior art oblique incidence optical system, multilayer reflecting optical system, zone plate or the like. For obtaining good focusing characteristics with the X-ray lens 10 or 20 according to this invention it may be necessary to conduct the machining of the unit lenses at a precision capable of keeping the geometric error within a small fraction of the value obtained by dividing the wavelength of the X-rays to be focused by $\delta$ of the lens material ($=\lambda/\delta$). Since the required precision is at most to within several μm, however, it can be easily achieved with available technologies.

The embodiments constituted using hollow cylinders 12 and hollow hemispheres 22 described in the foregoing have certain fundamental characteristics in common. Specifically, since the X-ray lenses 10 and 20 transmit the X-ray beam $X_R$ to be focused, they have intrinsically high focusing efficiency. Since, generally speaking, focusing performance and focusing efficiency are limited by the absorption of the lens material, it is an advantage of the X-ray lens according to this invention that it performs particularly well at short X-ray wavelengths under 1 nm. As can be understood from Equations (1) and (2) set out earlier, the X-ray lens is limited on the short wavelength side by the fact that $\delta$ decreases rapidly as the X-ray wavelength $\lambda$ grows shorter while the focal distance of the X-ray lens increases rapidly in inverse proportion to the $\delta$. Thus the wavelength range within which the X-ray lenses 10 and 20 are practically usable extends down to around 0.05 nm, a value which is considerably shorter than that achieved by the prior art X-ray optics discussed earlier. Thus the X-ray lens according to the invention also demonstrates its superiority on this point.

As seen in the foregoing embodiments, however, the spherical surface of Equation (4) is an approximation of the ideal paraboloid of revolution obtained from Equation (3), i.e., the spherical aberration is large for large value of r. One good way of overcoming or mitigating this problem is to adopt the configuration of the embodiments shown in FIGS. 7(*a*)–7(*c*).

The X-ray lens 10 shown in FIG. 7(*a*) is the same as the X-ray lens 10 of FIG. 3 in that it uses hollow cylinders 12 as the unit lenses 12 but is further provided at the X-ray entrance section with a correction section 30 relating to the optical characteristics of the X-ray beam $X_R$ to be focused. A first element of the correction section 30 is a spherical aberration correction element 32 provided to have its optical axis coincident with the array axis $X_C$.

As shown in FIG. 7(*b*), the spherical aberration correction element 32 is a round pillar whose thickest portion in the plane perpendicular to the axes of the hollow cylinders 12 (the plane in which the aperture of the hollow cylinders 12 is viewed) is at the center $X_O$ through which the array axis $X_C$ passes. Preferably, the thickness t(r) varies with distance r measured perpendicularly from the array axis $X_C$ as $$t(r)=(NR/4)(r/R)^4\{1+(r/R)^2/2\} \quad (8)$$

where N is the total number of unit lenses (hollow cylinders 12) used and R is either the actual radius of hollow cylinders 12 or the equivalent radius thereof calculated using Equation (7).

Since the shape seldom has to be in strict conformance with Equation (8), however, it suffices to use the following Equation (9) obtained by reducing the degree of Equation (8).

$$t(r)=(NR/4)(r/R)^4 \quad (9).$$

In addition, it is sometimes easier to approximate the round pillar as a polygonal prism and in such cases the spherical aberration correction element 32 of the configuration formed in accordance with Equation (8) or Equation (9) as shown in FIG. 7(*b*) can, as shown in FIG. 7(*c*), be modified to a solid element whose sectional profile 34 is constituted of straight line segments which approximate a semicircle. The polygonal prism formed in this manner is generally sufficient as the spherical aberration correction element 32.

There are two ways of obtaining an X-ray lens with a short focal distance: by increasing the number N of the hollow cylinders 12 or by reducing the radius of the hollow cylinders 12. As is clear from Equations (8) and (9), however, when the radius of the hollow cylinders 12 is reduced, the spherical aberration correction element 32 has to have large thickness if a large-aperture X-ray lens is to be obtained. A large radius is therefore better for obtaining an X-ray lens with a large aperture and a spherical aberration correction element 32 of minimum thickness (size).

The thickness of the lens material in the direction of X-ray transmission through the X-ray lens 10 shown in FIGS. 3–7(*a*) increases toward the periphery of the lens aperture, so that the X-ray intensity attenuation increases toward the periphery. This may become a factor limiting the size of the lens aperture. For overcoming this problem, the correction section 30 of the embodiment shown in FIG. 7 is further provided with an intensity correction element 31 for the transmitted X-rays.

The intensity correction element 31 is for making the intensity distribution uniform by intentionally attenuating the transmission intensity at the center of the lens. As shown in FIG. 7(*d*), the intensity correction element 31 can, for example, be a solid right cylinder having an elliptical section with a semimajor axis R. It is constituted of a material having a large value $\beta/\delta$. For size reduction, it is preferable to use a material having a large absorption coefficient $\delta$ (not having a small atomic number).

A precise elliptical configuration is not necessary in most actual applications, however, and it generally suffices to use instead an element with a radius $r_f$, maximum thickness $t_f$ and the sectional configuration of a circular segment, as shown in FIG. 7(*e*), or an even more simplified element which, as shown in FIG. 7(*a*), is a solid prism having the sectional configuration of a rectangle of thickness $t_f$ in the direction parallel to the array axis $X_C$ and width $W_f$ in the direction perpendicular to the array axis.

In the second specific example described earlier, for example, the effective lens diameter 2r is only 230 μm notwithstanding that the radius R of the hollow cylinders 12 constituting the unit lenses is 500 μm. Assume that this X-ray lens is provided with a spherical aberration correction element 32 made of the same carbon material as the lens material piece 11 in the form a solid polygonal prism whose width 2r in the direction perpendicular to the array axis $X_C$ is 500 μm and wherein t(r)=375 μm at r=0 μm
t(r)=325 μm at r=150 μm
t(r)=225 μm at r=200 μm
t(r)=0 μm at r=250 μm.

Although this configuration indeed reduces the spherical aberration with respect to the incident X-ray beam $X_R$, the X-ray transmittance in the vicinity of r=250 μm falls to 10% of that at the center. If an intensity correction element 31 constituted as a rectangular tungsten prism of width $W_f$=250 μm and thickness $t_f$=120 μm is further incorporated, the unevenness in the X-ray transmission intensity distribution can be reduced to one-third or less. Even more uniform distribution can be obtained by forming the intensity correction element 31 as a portion of a solid right cylinder having the sectional shape of a circular segment, such as shown in FIG. 7(*e*), to have, for example, a radius $r_f$ of 1 mm and a maximum thickness $t_f$ of 240 μm.

The same principle can also be applied to the embodiments having hollow hemispheres 22 as the unit lenses. For example, an X-ray lens 20 having N number of unit lenses constituted as hollow hemispheres 22 as shown in FIG. 8(*a*) can be provided with a solid spherical aberration correction element 32 which has a plan view configuration like that of FIG. 7(*b*) and either satisfies or approximately satisfies Equation (8) or Equation (9) and further, as shown in FIG. 8(*b*), is configured such that its thickness $h(X_C)$ also varies with distance from the array axis $X_C$ in the direction perpendicular to both the array axis $X_C$ and the plane including the aperture of the hollow hemispheres 22 so as to satisfy or approximately satisfy the relationship $$h(X_C)=(NR/4)\,(r/R)^4\{1+(r/R)^2/2\} \quad (10)$$

or the somewhat simplified relationship $$h(X_C)=(NR/4)(r/R)^4 \quad (11).$$

As shown in FIG. 8(*d*), the intensity correction element 31 of the X-ray lens 20 is preferably a solid element shaped as an ellipsoid of revolution so as to configurationally complement the group of N number of unit lenses constituted as hollow hemispheres 22. As shown in FIG. 8(*e*), however, it can instead be constituted in an easy to fabricate conical shape or, as shown in FIG. 8(*a*), as a prism element of rectangular section to give it the simplest configuration in plan view.

In the embodiments of FIGS. 7 and 8 the spherical aberration correction element 32 and the intensity correction element 31 are formed on a correction section substrate 33 integral with the lens material piece 11 or 21. However, it is also possible to form the substrate 33 of an appropriately selected material as a separate member from the lens material piece 11 or 21 or to form the spherical aberration correction element 32 and the intensity correction element 31 each on its own substrate. Moreover, the correction section 30 does not necessarily have to be provided at the X-ray entrance section of the X-ray lens 10 or 20 but instead can be located at an intermediate portion of the transmission path of the X-ray beam $X_R$. In special cases, the N number of unit lenses 12, 22 can be a first group consisting of K number of consecutive unit lenses an a second group consisting of L number of consecutive unit lenses, where K+L=N, and the correction section 30 be provided between the two groups.

The absorption of the transmitted X-rays decreases as the thickness of the lens material between adjacent pairs of the N number of unit lenses (hollow cylinders 12, 12 or hollow hemispheres 22, 22) aligned along the array axis $X_C$ becomes thinner. Thus absorption of transmitted X-rays can be reduced by aligning the hollow cylinders 12 or the hollow hemispheres 22 in close proximity such that the thickness of the lens material between adjacent unit lenses becomes zero or almost zero at the point of intersection with the array axis $X_C$. In some cases it is possible to form adjacent pairs of the hollow cylinders 12, 12 or adjacent pairs of the hollow hemispheres 22, 22 so as to partially overlap in the direction of the array axis.

Figure 9A:
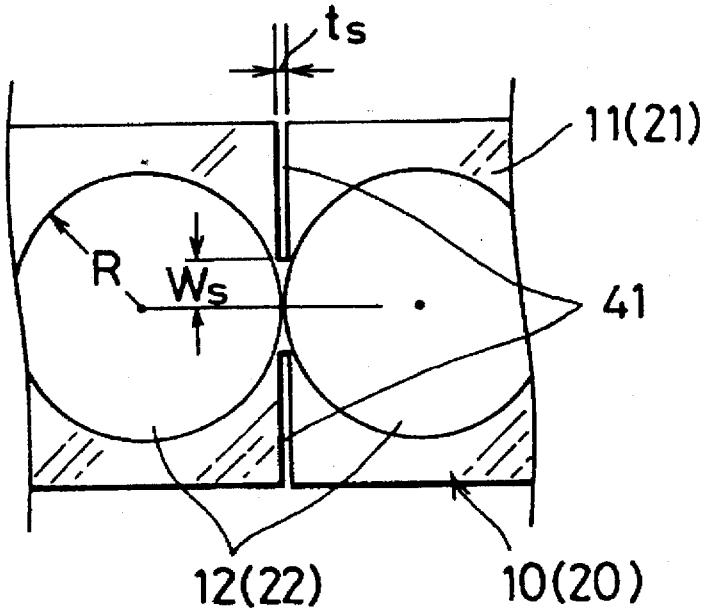
FIGS. 9(*a*) and 9(*b*) are explanatory views showing means for overcoming the problem of x-ray absorption by the thickness of the lens material between the unit lenses in the embodiments according to the invention.
Figure 9B:
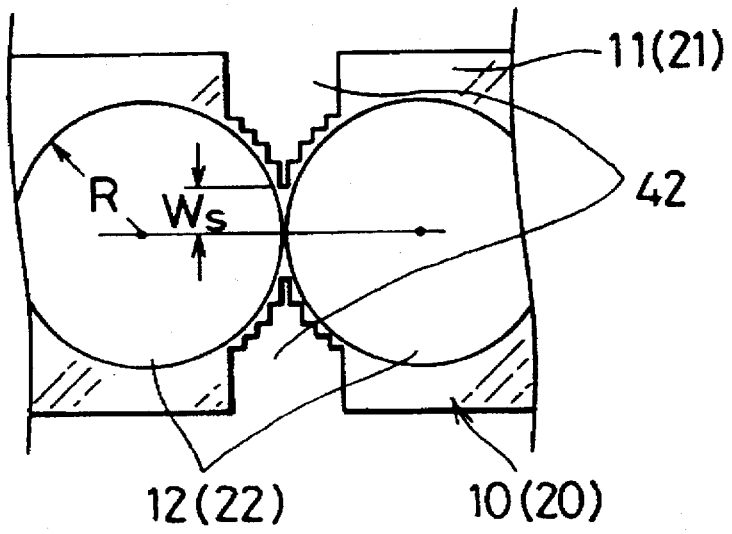

Further, X-ray absorption can be considerably reduced, particularly in the case of the hollow cylinder type unit lenses 12, by, as shown in FIG. 9(*a*), providing between each pair of adjacent unit lenses gaps of width ts that extend from the lens peripheries in the direction perpendicular to the array axis $X_C$. In this case, the aforesaid intensity correction element 31 may be unnecessary, though its use is not precluded. A particularly good X-ray absorption reduction effect can be obtained without degrading the lens effect by, as shown in FIG. 9(*a*), providing straight groove-like gaps 41, 41 formed as grooves whose inward facing walls extend in parallel.

For example, if the second specific example described earlier is formed with hollow cylinders 12 of R=500 μm aligned in close proximity along the array axis $X_C$, the X-ray transmittance at r=250 μm is increased 30% by the formation between each adjacent pair of the hollow cylinders 12 of straight groove-like gaps 41, 41 of width ts=60 μm which start from points at a distance $W_S$=200 μm measured perpendicularly outward from the array axis $X_C$ passing through the center of the unit lenses and extend toward the opposite edges.

The X-ray absorption distribution can be made even more uniform by forming the gaps so that their width in the direction parallel the array axis $X_C$ becomes smaller from the periphery toward the array axis $X_C$. Thus, as shown in FIG. 9(*b*), it is preferable to provide step-like gaps 42 whose width in the direction parallel to the array axis $X_C$ becomes progressively narrower in steps from the periphery toward the array axis $X_C$.

The same principle can also be applied to the embodiments having hollow hemispheres 22 as the unit lenses. This is why the reference symbols 20, 21, 22 are parenthetically included in FIG. 9. When hollow hemispheres 22 are used, it is preferable to provide step-like gaps like those shown in FIG. 9 (*b*) so as also to extend into the lens material piece 21 between adjacent unit lenses 22, 22 in the sectional direction perpendicular to the drawing sheet of FIG. 9 in such manner that their widths increase with increasing distance from the center. Since the formation of such gaps is troublesome, however, the means according to FIG. 9 are generally better suited for use with unit lenses constituted as hollow cylinders 12.

While embodiments were described in detail in the foregoing, various modifications are possible within the technical scope of the invention. Moreover, in the X-ray lens using the hollow hemispheres 22, the technical concept of this invention extends not only to the case where perfect hollow hemispheres cannot be formed owing to limited machining precision but also to the case where the hollow hemispheres are deliberately formed to deviate from the true shape of hollow hemispheres. For example, the focal distance shortening effect according to the present invention can also be obtained by aligning in proximity along the array axis N number of depressions each formed as part of a hollow spherical surface (spherical space) but having its aperture not at a latitude of 180° on the hollow spherical surface but at an arbitrary latitude of less than 180°.

The X-ray lens for focusing an X-ray beam according to this invention is constituted of a group of N number of unit lenses, but since the individual unit lenses are formed to have spherical surfaces or circular sections, it can be fabricated to high precision much more easily than can the prior art X-ray optical elements. Moreover, it does not utilize oblique incidence as found in some of the prior art X-ray optics but adopts intrinsically superior normal incidence. In addition, since, as was pointed out earlier, very small diameter unit lenses can be produced with high precision, the X-ray lens can be fabricated to be utilizable over a wide X-ray wavelength range. Further, since the applicable range is particularly easy to extend toward the short wavelength side, high focusing performance can be obtained. Since the X-ray lens is of the transmission type, moreover, it can achieve high focusing efficiency. In fact it is possible according to this invention to provide X-ray lenses which are for the first time capable of focusing an X-ray beam of a wavelength of 1 nm or less to a small diameter with high efficiency.

What is claimed is:

1. An X-ray lens for focusing X-rays comprising N number (N≧2) of unit lenses each constituted by forming a hollow hemisphere in a piece of lens material capable of transmitting X-rays to be focused, the centers of the hollow hemispheres being aligned on a straight array axis.

2. An X-ray lens according to claim 1, wherein all of hollow hemispheres constituting the unit lenses are formed in a single lens material piece.

3. An X-ray lens according to claim 1, wherein the N number of hollow hemispheres have radii Rj (1≦j≦N) which are equal.

4. An X-ray lens according to claim 1, wherein the N number of hollow hemispheres have radii Rj (1≦j≦N) all or some of which are different.

5. An X-ray lens according to claim 1, further comprising a spherical aberration correction element for correcting spherical aberration of the N number of unit lenses, which is located on a transmission path of X-rays entering the X-ray lens along the array axis.

6. An X-ray lens according to claim 5, wherein the spherical aberration correction element is formed on a substrate which is unitary with the lens material piece.

7. An X-ray lens according to claim 5, wherein the spherical aberration correction element is a solid body whose thickness t(r) varies with distance r from the array axis measured in the direction perpendicular to the array axis and parallel to the plane including an aperture of the hollow hemispheres as $$t(r)=(NR/4)(r/R)^4\{1+(r/R)^2/2\},$$

where R is a value obtained by dividing the number N by the sum of the reciprocals of the radii Rj ($1 \leqq j \leqq N$) of individual the hollow hemispheres.

8. An X-ray lens according to claim 7, wherein the spherical aberration correction element is a solid body whose configuration in a section including the array axis is such that its thickness $h(X_C)$ varies with distance $X_C$ from the array axis in the direction perpendicular to the array axis and perpendicular to a plane including an aperture of the hollow hemispheres as $$h(X_C)=(NR/4)\,(r/R)^4\{1+(r/R)^2/2\}.$$

9. An X-ray lens according to claim 7, wherein the spherical aberration correction element is a solid body whose configuration in a section including the array axis is such that its thickness $h(X_C)$ varies with distance $X_C$ from the array axis in the direction perpendicular to the array axis and perpendicular to a plane including an aperture of the hollow hemispheres approximately as $$h(X_C)=(NR/4)\,(X_C/R)^4.$$

10. An X-ray lens according to claim 7, wherein the spherical aberration correction element is a solid body whose configuration in a section including the array axis is such that its thickness $h(X_C)$ varies with distance $X_C$ from the array axis in the direction perpendicular to the array axis and perpendicular to a plane including an aperture of the hollow hemispheres approximately as $$h(X_C)=(NR/4)\,(r/R)^4\{1+(r/R)^2/2\}.$$

11. An X-ray lens according to claim 7, wherein the spherical aberration correction element is a solid body whose configuration in a section including the array axis is such that its thickness $h(X_C)$ varies with distance $X_C$ from the array axis in the direction perpendicular to the array axis and perpendicular to a plane including an aperture of the hollow hemispheres approximately as $$h(X_C)=(NR/4)\,(X_C/R)^4.$$

12. An X-ray lens according to claim 5, wherein the spherical aberration correction element is a solid body whose thickness t(r) varies with distance r from the array axis measured in the direction perpendicular to the array axis and parallel to the plane including an aperture of the hollow hemispheres as $$t(r)=(NR/4)(r/R)^4,$$

where R is a value obtained by dividing the number N by the sum of the reciprocals of the radii Rj ($1 \leqq j \leqq N$) of the individual hollow hemispheres.

13. An X-ray lens according to claim 5, wherein the spherical aberration correction element is a solid body whose thickness t(r) varies with distance r from the array axis measured in the direction perpendicular to the array axis and parallel to the plane including an aperture of the hollow hemispheres approximately as $$t(r)=(NR/4)(r/R)^4\{1+(r/R)^2/2\},$$

where R is a value obtained by dividing the number N by the sum of the reciprocals of the radii Rj ($1 \leqq j \leqq N$) of individual the hollow hemispheres.

14. An X-ray lens according to claim 5, wherein the spherical aberration correction element is a solid body whose thickness t(r) varies with distance r from the array axis measured in the direction perpendicular to the array axis and parallel to the plane including an aperture of the hollow hemispheres as $$t(r)=(NR/4)(r/R)^4,$$

where R is a value obtained by dividing the number N by the sum of the reciprocals of the radii Rj ($1 \leqq j \leqq N$) of the individual hollow hemispheres.

15. An X-ray lens according to claim 1, further comprising an intensity correction element for uniformizing transmission intensity distribution of the N number of unit lenses, which is located on a transmission path of X-rays entering the X-ray lens along the array axis.

16. An X-ray lens according to claim 15, wherein the intensity correction element is formed on a substrate which is unitary with the lens material piece.

17. An X-ray lens according to claim 15, wherein the intensity correction element is a solid body shaped as an ellipsoid of revolution having a semiminor axis lying on the array axis of the N number of unit lenses and a semimajor axis of R and attenuates the intensity of the X-rays transmitting through the N number of unit lenses at a rate which increases from the periphery of the N number of unit lenses toward the center thereof, where R is a value obtained by dividing the number N by the sum of the reciprocals of the radii Rj ($1 \leqq j \leqq N$) of the individual hollow hemispheres.

18. An X-ray lens according to claim 7, wherein the solid body shaped as an ellipsoid of revolution is approximated by a conical solid body.

19. An X-ray lens according to claim 1, wherein the lens material piece is made of lithium.

20. An X-ray lens according to claim 1, wherein the lens material piece is made of beryllium.

21. An X-ray lens according to claim 1, wherein the lens material piece is made of carbon.

22. An X-ray lens according to claim 1, wherein the lens material piece is made of chromium.

23. An X-ray lens according to claim 1, wherein the lens material piece is made of aluminum.

24. An X-ray lens according to claim 1, wherein the lens material piece is made of silicon.

25. An X-ray lens according to claim 1, wherein the piece of lens material is formed in portions thereof between pairs of unit lenses adjacent in the direction of the array axis with gaps for reducing attenuation of transmitted X-ray intensity, said gaps extending from opposite peripheral regions toward the array axis.

26. An X-ray lens according to claim 25, wherein the gaps are straight grooves extending perpendicularly to the array axis in a plane parallel to a plane including an aperture of the hollow hemispheres.

27. An X-ray lens according to claim 25, wherein the gaps extend perpendicularly to the array axis in a plane parallel to a plane including an aperture of the hollow hemispheres and become narrower in the direction parallel to the array axis with increasing distance from the peripheral regions toward the array axis.

28. An X-ray lens according to claim 25, wherein the gaps extend perpendicularly to the array axis and, in a plane perpendicular to a plane including an aperture of the hollow hemispheres and parallel to the array axis, become narrower in the direction parallel to the array axis with increasing distance from the peripheral regions toward the array axis.

29. An X-ray lens according to claim 25, wherein the gaps extend perpendicularly to the array axis in a plane parallel to a plane including an aperture of the hollow hemispheres and become progressively narrower in steps in the direction parallel to the array axis with increasing distance from the peripheral regions toward the array axis.

30. An X-ray lens according to claim 25, wherein the gaps extend perpendicularly to the array axis in a plane perpendicular to a plane including an aperture of the hollow hemispheres and parallel to the array axis and become progressively narrower in steps in the direction parallel to the array axis with increasing distance from the peripheral regions toward the array axis.

31. An X-ray lens according to claim 1, wherein the thickness of the material of the lens material piece between pairs of hollow hemispheres adjacent in the direction of the array axis is zero or almost zero at the portion intersecting the array axis in a plane including an aperture of the hollow hemispheres.

32. An X-ray lens according to claim 1, wherein the thickness of the material of the lens material piece between pairs of hollow hemispheres adjacent in the direction of the array axis is zero at the portion intersecting the array axis in a plane including an aperture of the hollow hemispheres and the adjacent hollow hemispheres partially overlap in the direction of the array axis.

33. An X-ray lens comprising first and second sublenses each constituted in the manner of the X-ray lens of claim 1, one of the sublenses being inverted and placed on top of the other with the axes of the hollow hemispheres perpendicular to the array axis.

34. An X-ray lens according to claim 1, wherein the hollow hemispheres are replaced by depressions each formed as part of a hollow spherical surface.

35. An X-ray lens according to claim 34, further comprising a spherical aberration correction element for correcting spherical aberration of the N number of unit lenses, which is located on a transmission path of X-rays entering the X-ray lens along the array axis.

36. An X-ray lens according to claim 34, further comprising an intensity correction element for uniformizing transmission intensity distribution of the N number of unit lenses, which is located on a transmission path of X-rays entering the X-ray lens along the array axis.

37. An X-ray lens according to claim 34, wherein the piece of lens material is formed in the portion thereof between pairs of unit lenses adjacent in the direction of the array axis with gaps for reducing attenuation of transmitted X-ray intensity, said gaps extending from opposite peripheral regions toward the array axis.

38. An x-ray refractive lens for focusing x-rays, comprising:

N number of hollow unit lenses, each of the N hollow unit lenses constituted by a removable part of a piece of lens material capable of transmitting x-rays to be focused; and wherein all of the N hollow unit lenses are arranged so that their focal points are all on a straight array axis along which the x-rays propagate, wherein $N \geqq 2$.

* * * * *